United States Patent [19]

Farmer

[11] Patent Number: 4,660,310

[45] **Date of Patent: * Apr. 28, 1987**

[54] ADVERTISING COPY DISPLAY SIGN AND STAND COMBINATION

[76] Inventor: Kenneth R. Farmer, 891 Glenbrook Dr., N.W., Atlanta, Ga. 30318

[ * ] Notice: The portion of the term of this patent subsequent to Oct. 28, 2000 has been disclaimed.

[21] Appl. No.: 196,843

[22] Filed: Oct. 14, 1980

[51] Int. Cl.[4] ..... G09F 15/00

[52] U.S. Cl. ..... 40/607; 40/10 C; 40/606

[58] Field of Search ..... 40/10 C, 606, 607, 595; 40/584

[56] References Cited

U.S. PATENT DOCUMENTS

| | | | |
|---|---|---|---|
| 343,365 | 6/1886 | Daniels | 40/606 |
| 1,638,193 | 8/1927 | Forwood | 40/606 |
| 1,830,960 | 11/1931 | Philibert | 40/595 |
| 2,012,990 | 9/1935 | Choate | 40/10 C |
| 2,328,807 | 9/1943 | Hoofer | 40/10 C |
| 2,333,302 | 11/1943 | Enk | 40/10 C |
| 2,914,874 | 12/1959 | Stein | 40/607 |
| 3,350,804 | 11/1967 | Guyer et al. | 40/610 |
| 3,889,409 | 6/1975 | Thomas | 40/606 |
| 4,092,792 | 6/1978 | Vorhees | 40/607 |
| 4,259,803 | 4/1981 | Sittler | 40/606 |

*Primary Examiner*—Gene Mancene
*Assistant Examiner*—Wenceslao J. Contreras
*Attorney, Agent, or Firm*—Wigman & Cohen

[57] ABSTRACT

Disclosed herein is an advertising display sign and stand combination which comprises a double sided display sign having printed thereon advertising copy and changeable copy display area and a stand member removably attached to the double sided display side adapted to allow the sign stand combination to be implanted in the earth without the use of tools.

14 Claims, 5 Drawing Figures

ADVERTISING COPY DISPLAY SIGN AND STAND COMBINATION

BACKGROUND OF THE INVENTION

The present invention relates to display devices and apparatus for holding signs and methods and means for fabricating such display devices.

The prior art includes brackets for holding signs which have channels closed by spring means or the resilient pressure of the channel material. In such arrangements the sides of the channel are forced apart by insertion of the sign. This arrangement is not satisfactory for outdoor use such as on the top of a gas pump or in a yard where occasionally there is high wind and also where people might bump the top of the pump and the sign from time to time. The problem is that of holding a simple folded sign arrangement in place in the earth where the sign is easily removed and replaced, but at the same time at a complete cost that is not prohibitive for the use intended. More elaborate arrangements employing spring means and latches will hold the sign in place, but such devices are too expensive and difficult to manipulate in replacing the signs. Also included in the prior art are display devices of the type disclosed in U.S. Pat. No. 3,736,682 which discloses a device constructed as a two-sided sign from folded sheet material such as plastic or cardboard having the side edges joined and sealed by glue to provide an overseas cap-like arrangement and the bottom edges along the bottom opening each having an inwardly bent tab fitting into a respective side bracket which comprises a case attached by pressure sensitive tape to a surface such as the top of a gas pump or like platform and depressions or indentations on each side of the case in which the sign tab fits. A bottom plate on the case with an upturned edge provides a bottom channel in which the depending side plates of the top cover cap extend to provide a closed slot overlying the respective indentations in which fit the tab thereby making it difficult to displace the sign from the bracket.

SUMMARY OF THE INVENTION

The present invention is a yard or directional sign made of two plastic panels mounted on a steel stand to form a single unit which is easily implanted in the earth, light weight and weather resistant which and can be fabricated at minimum cost. The plastic panels are constructed in such a fashion that preprinted advertising copy can be imprinted on a portion or portions thereof and other areas of the panels are adapted to accept changeable copy panels or decals. The present display device eliminates the necessity for nuts and bolts or other fastening devices normally associated with the construction of yard or directional signs such as are used in real estate promotions and also eliminates the time consuming process of removing rusty and bent metal copy display panels which become difficult to work with after exposure to the elements. The present invention further provides an advertising display device on which portions of the copy can be changed almost at will without the necessity of dismantling the device.

OBJECTS OF THE INVENTION

It is therefore an object of the present invention to provide a sign made of two plastic panels molded over a steel stand to form a single unit which may be easily implanted in the earth without using a hammer, mallet or other driving tool.

It is another object of the present invention to provide a sign adapted to display advertising copy which is permanently printed on the display panels of the sign as well as advertising copy which may be readily added to or taken away from the copy display area of the sign by use of changeable decals.

Yet another object of the present invention is to provide means for assembling and implanting the sign stand combination in the earth without the need of tools.

These and other objects features and advantages of the present invention will become readily apparent by a reading of the following description of the preferred embodiment in conjunction with the accompanying drawings and appended claims.

DESCRIPTION OF THE PREFERRED EMBODIMENT

Figure 1:
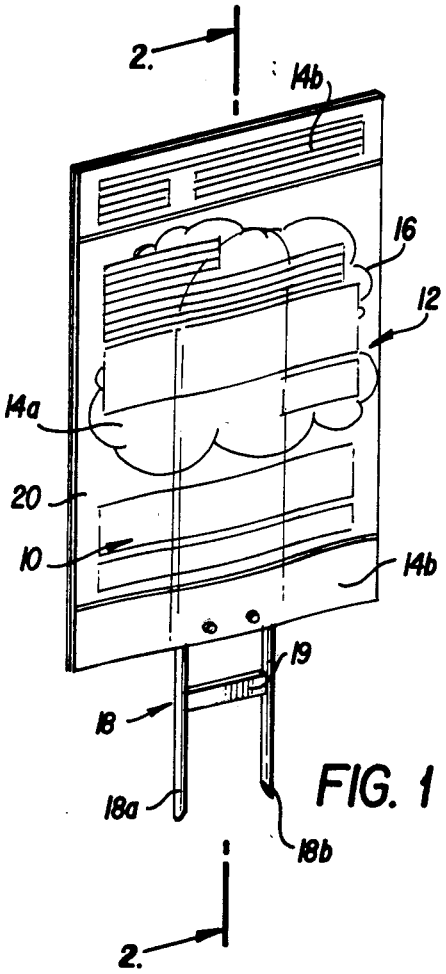
FIG. 1 is a perspective view of the present sign as it might appear in place in a yard.

In FIG. 1 the complete sign and stand combination is designated generally by reference numeral 10 and comprises a double sided display sign designated generally by reference numeral 12 comprising a copy display side 14 (FIG. 1A) on each side thereof, said copy display side further comprising a preprinted copy display area **14*a* on each side adjacent to at least one, and generally more than one, changeable copy display areas 14*b* on each side which have typical advertising material displayed thereon. Decals bearing preprinted advertising copy and adapted to be attached to a surface by means of an adhesive may be added or removed from changeable copy display areas 14*b*** at will.

Figure 1A:
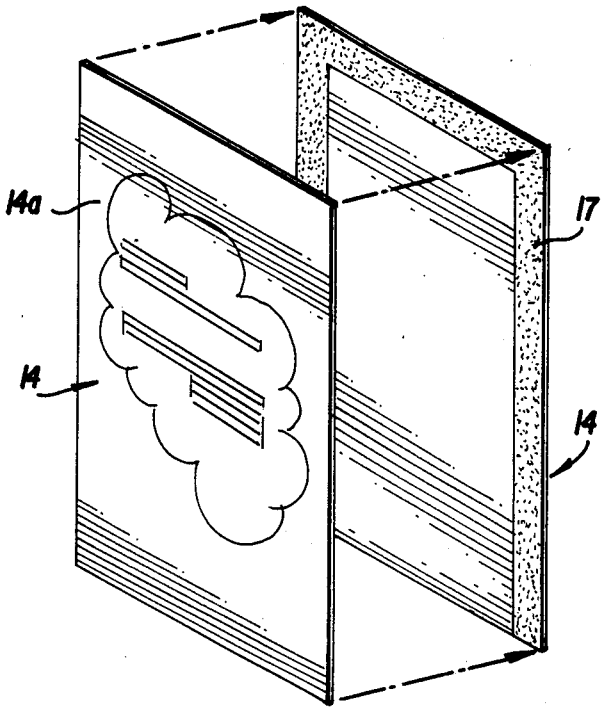
FIG. 1A is an exploded view of certain components of the present invention in an unassambled condition.
Figure 1B:
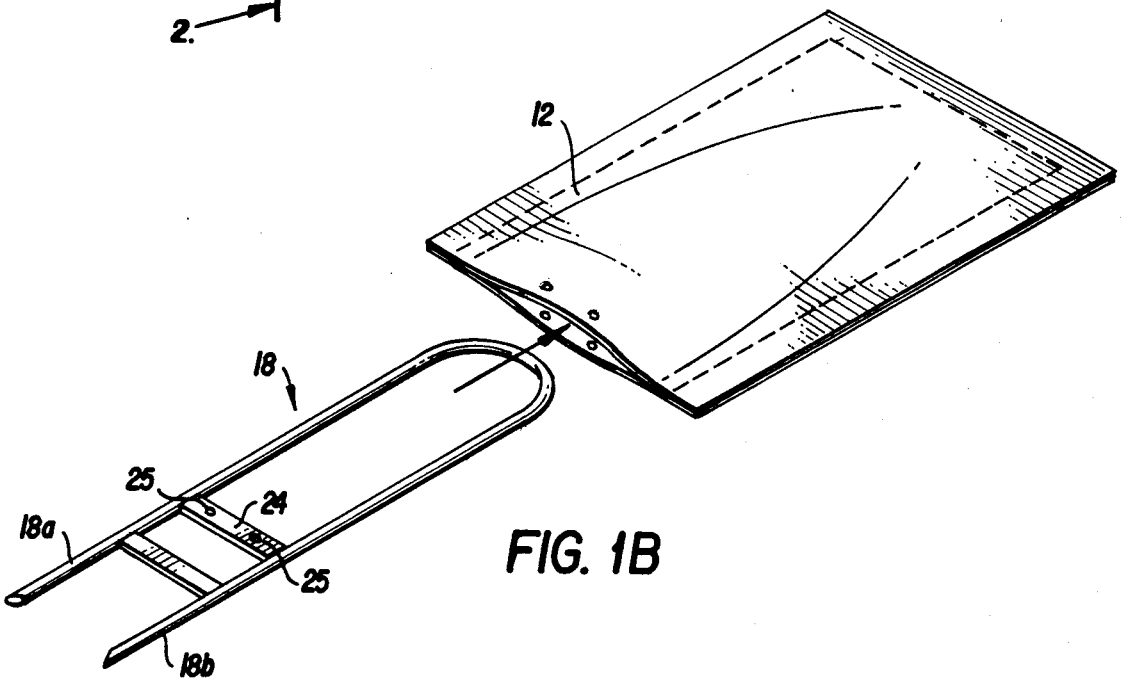
FIG. 1B is a partial exploded view of the present invention.
Figure 2:
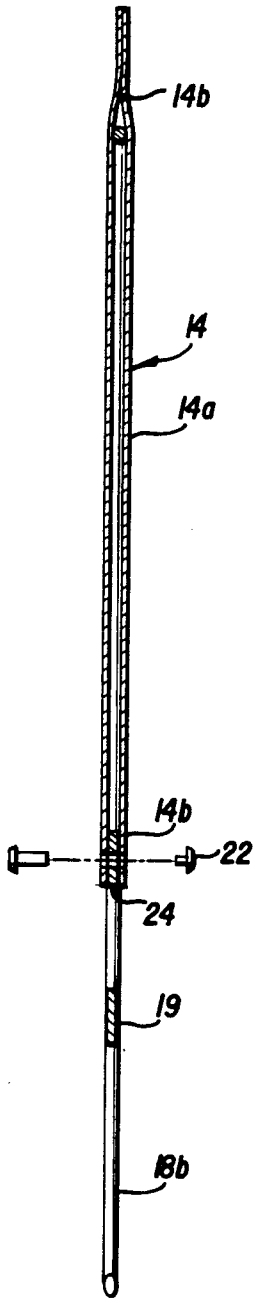
FIG. 2 is a cross-sectional view taken substantially along line 2—2 of FIG. 1.

It can be seen from FIGS. 1A and 1B that the sign 12 is formed from preprinted thermoplastic sheets which are brought together so that the respective edges 17 of display sides 14 are brought together in superposed coextensive relation and fused together with an appropriate solvent such as methylethyl ketone to form one solid edge which creates a sort of overseas-cap-like or envelope-like arrangement with the display sides 14 forming a slightly curved configuration which tightly grips the steel stand 18 for forming the sign stand combination 10 when steel stand 18 is inserted between display sides 14. Additionally, solvents such as tetrahydrofuran, acetone, methylisobutylketone, n-methylpyrrole, methylbutylketone, dimethylformamide, toluene, benzene, petroleum ether, methylenechloride, Lanosal 150, and mixtures thereof may may be used. The bond formed between sides 14 may be achieved either by a solvent mechanism or adhesive mechanism. Generally any solvent for styrene, nylon, methylmethacrylate, polycarbonate, rigid polyvinyl chloride, polypropylene, polyethylene or acrilonitrilebutadienestyrene would be acceptable because these materials are preferred for use in fabricating sides 14.

Figure 3:
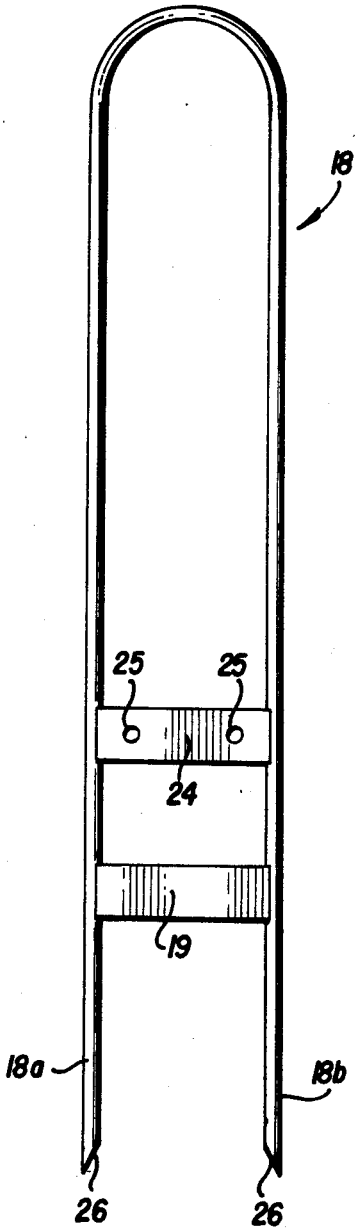
FIG. 3 is a frontal view of the stand component of the present invention.

Steel stand 18 shown in FIG. 3 comprises an inverted U-shaped member the closed portion of which is adapted for insertion between display sides 14. The opposite open end of U-shaped steel stand 18 projects from the envelope created by display sides 14 a distance sufficient to allow the steel stand 18 to be firmly implanted in the earth while holding the double sided display 12 at a height appropriate for good visibility. Stand shafts 18*a* and 18*b* are connected by cross members 19 and 25 in a manner whereby stand 18 can be firmly implanted in the earth by placing one's foot on said cross member 19 and pressing down sharply thereby eliminating the necessity of using a hammer, a mallet or other driving tool to drive the sign into the ground. Additionally, cross member 24 is adapted to receive fasteners 21, 22 through drillings 25 whereby the envelope created by display sides 14 may be securely attached to stand 18 to form the completed sign stand combination 10. Stand shafts 18*a* and 18*b* of U-shaped stand 18 are generally fabricated from a material such as ¼ inch round steel rod and cross members 19 and 25 are usually fabricated from a material such as 1 inch steel bar. Further, the ends 26 of shafts 18*a* and 18*b* are generally sharp to facilitate the implanting of same into the earth.

While the invention has been shown and described in terms of one embodiment thereof, this description is by way of illustration only since there are various alterations, ramifications, elucidations, combinations, omissions, departures, additions and changes which may be made in the form shown and described without departing from the scope of the invention so defined by proper interpretation of the appended claims.

What is claimed is:

1. An advertising display sign and stand combination which comprises a double-sided display sign having printed thereon advertising copy and changeable copy display areas adapted to receive adhesive backed decals having advertising copy printed thereon and a stand member removably attached to said double-sided display sign adapted to facilitate installation of the sign and stand combination in the earth without the use of driving tools, said double-sided display sign comprising thermoplastic sheets fused in superposed coextensive relation to create an envelope-like arrangement adapted to receive said stand, said stand comprising an inverted U-shaped member adapted for insertion of the base of said U into said envelope like arrangement with the long sides of said U-shaped member being joined by a cross member at points whereby said sign may be implanted into the earth at the optimum height for display of advertising copy imprinted on said sign.

2. An advertising display sign and stand combination which comprises a double-sided display sign having printed thereon advertising copy and changeable copy display areas and a removably attached stand member adapted to allow the sign and stand combination to be implanted in the earth said stand member comprising an inverted U-shaped member adapted for insertion of the base of said U into an envelope formed by the double-sided display sign with the long sides of said U-shaped member being joined by a cross member at points whereby said sign may be implanted into the earth at the optimum height for the display of advertising copy imprinted on said sign.

3. The advertising display sign and stand combination of claim 2, wherein said cross member further includes means for securely attaching said advertising display sign to said stand.

4. The advertising display sign and stand combination of claim 3 wherein said means for securely attaching said advertising display sign to said stand comprises drillings spaced along said cross member and said advertising display sign for interconnecting said display sign and said stand with fastener projecting therethrough.

5. The advertising display sign and stand combination of claim 4 wherein said stand further includes means adapted to facilitate the implanting of same into the earth.

6. An advertising display sign comprising an envelope having two display surfaces for receiving advertising copy thereon, said envelope having one open side, a stand member having a first end removably inserted into the open side of said envelope and a second end adapted to be implanted in the earth, said stand member comprising at least two spaced elongated shafts, said envelope enclosing the first end of the stand member with the second end thereof projecting outwardly from the open side of said envelope, and a first cross member connected transversely between said shafts outwardly of said envelope and adjacent the second end of said stand member for implanting said stand member in the earth by applying a downward driving force to said first cross member.

7. The advertising display sign according to claim 6 wherein said two shafts are parallel and are connected together at the first end of said stand member.

8. The advertising display sign according to claim 6 wherein said stand member has an inverted U-shape, the closed portion of which comprises said first end and the open end of which comprises said second end.

9. The advertising display sign according to claim 6 wherein said envelope is sealed along at least two parallel sides thereof.

10. The advertising display sign according to claim 6 including a second cross member connected transversely between said shafts, said envelope and said second cross member each having at least one through drilling, and fastener means extending through said drillings for securely attaching the envelope to the stand member.

11. The advertising display sign according to claim 10 including at least two drillings disposed in said envelope adjacent the open side thereof.

12. The advertising display sign according to claim 6 wherein said envelope comprises a pair of rectangular sheets connected together along three sides thereof.

13. The advertising display sign according to claim 12 wherein said rectangular sheets are formed of a thermoplastic material and are arranged in superposed, coextensive relation.

14. The advertising display sign according to claim 6 wherein the two display surfaces of said envelope form a curved configuration which grips the first end of said stand member.

* * * * *